US007377834B2

(12) United States Patent
Fu

(10) Patent No.: US 7,377,834 B2
(45) Date of Patent: May 27, 2008

(54) SHAPING PANT

(75) Inventor: Li-Ching Fu, Fongshan (TW)

(73) Assignee: So. Rose Corp., Kaohsiung County (TW)

( * ) Notice: Subject to any disclaimer, the term of this patent is extended or adjusted under 35 U.S.C. 154(b) by 329 days.

(21) Appl. No.: 11/179,590

(22) Filed: Jul. 13, 2005

(65) Prior Publication Data

US 2007/0015439 A1 Jan. 18, 2007

(30) Foreign Application Priority Data

Jan. 24, 2005 (TW) ..... 94201255 U

(51) Int. Cl.
*A41C 1/00* (2006.01)

(52) U.S. Cl. ..... 450/99; 450/100

(58) Field of Classification Search ..... 450/99–104, 450/106, 112, 123–125; 2/228, 236, 73, 2/78.1–78.4

See application file for complete search history.

(56) References Cited

U.S. PATENT DOCUMENTS 2,569,229 A * 9/1951 Cooper ..... 450/99
3,245,409 A * 4/1966 Martin ..... 450/104
3,270,748 A * 9/1966 Cuozzi ..... 450/104
3,406,692 A * 10/1968 Pernas ..... 450/116
5,954,564 A * 9/1999 Ganz ..... 450/99

* cited by examiner

*Primary Examiner*—Gloria M. Hale
(74) *Attorney, Agent, or Firm*—Rosenberg, Klein & Lee

(57) ABSTRACT

A shaping pant is made of tailored inner and outer layers of elastic clot, which are sewn together by using sewing machines; the shaping pant includes a front, a bottom, and a rear; the rear has a single-layer gathering portion at a middle thereof, which is substantially in the shape of a heart, curving and symmetric about a central line of the shaping pant; the single-layer gathering portion is sewn in position at edges thereof; therefore, air will travel through the single-layer gathering portion easily, and the wearer's butt will be lifted and shaped, looking rounder.

7 Claims, 4 Drawing Sheets

SHAPING PANT

BACKGROUND OF THE INVENTION

1. Field of the Invention

The present invention relates to a shaping pant, more particularly one, of which a rear has a single-layer gathering portion at the middle, substantially in the shape of a heart, curving and symmetric about a central line such that air can travel through the rear more easily, and the wearer's butt will be lifted and shaped to look rounder, and the shaping pant is comfortable to wear.

2. Brief Description of the Prior Art

Ladies wear shaping pants to shape their bodies, and prevent the waists, underbelly, and butts, on which superfluous fleshes are prone to grow, from changing shape.

Various kinds of shaping pants are available for serving a common purpose, to help the wearer's bodies beautifully shaped, which are made in different materials, shapes, and sizes, and will lift and gather a particular body portion of the wearers.

However, conventional shaping pants will only bind the wearers' butts. Not only do they fail to shape the wearers' butts into a desirable roundly curved contour, they will also cause uncomfortable pressure on the wearers' butts and limit the movement of the wearers' butts.

Moreover, most conventional shaping pants are made of relatively thick cloth so as to have enough tightness. Consequently, air can't travel through the rear portions of the shaping pants easily, and the wearers are prone to perspire, and the perspiration gathers in the clefts between the buttocks, causing hygiene problems.

SUMMARY OF THE INVENTION

It is a main object of the invention to provide an improvement on a shaping pant to overcome the above-mentioned problem. The shaping pant of the present invention is made of tailored inner and outer layers of elastic cloth, which are sewn together by means of sewing machines. The shaping pant includes a front, a bottom, and a rear; the rear has a single-layer gathering portion at a middle, which is substantially in the shape of a heart, curving and symmetric about a central line of the shaping pant. The single-layer gathering portion is sewn in position at edges. Therefore, air will travel through the single-layer gathering portion easily, and the wearer's butt will be lifted and shaped, looking rounder. Each of the cloth layers of the front and the rear can be a piece of elastic mesh cloth with negative ions. The bottom can be a piece of nanometer light catalyst cloth or a piece of elastic mesh cloth with negative ions. The outer layer of each of the tight-binding tube portions is a piece of elastic mesh cloth with negative ions. The lateral portions of the inner elastic cloth layers of the tight-binding tube portions are made in such a way that they can absorb moisture and allow perspiration to flow out.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
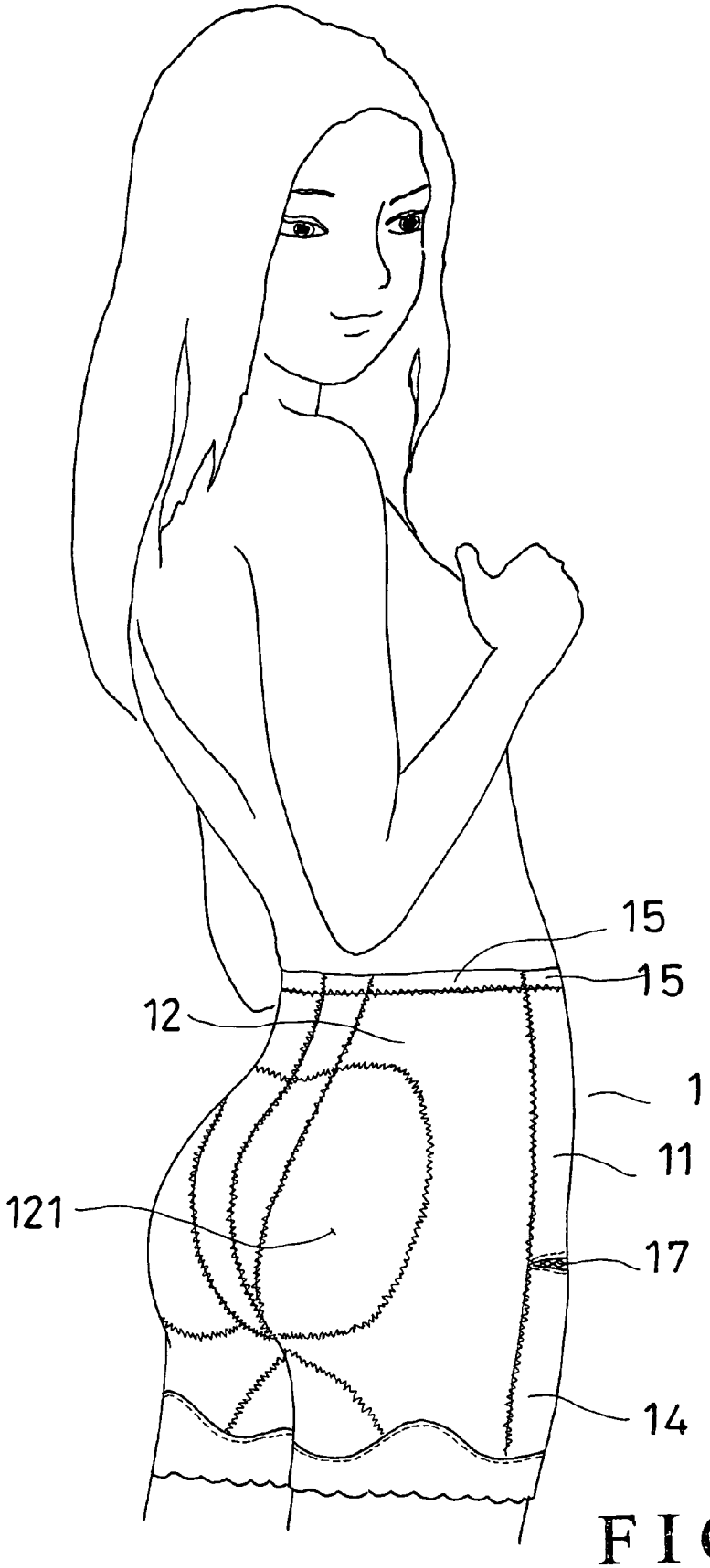
FIG. 1 is a perspective view of the shaping pant of the present invention worn on a lady.
Figure 2:
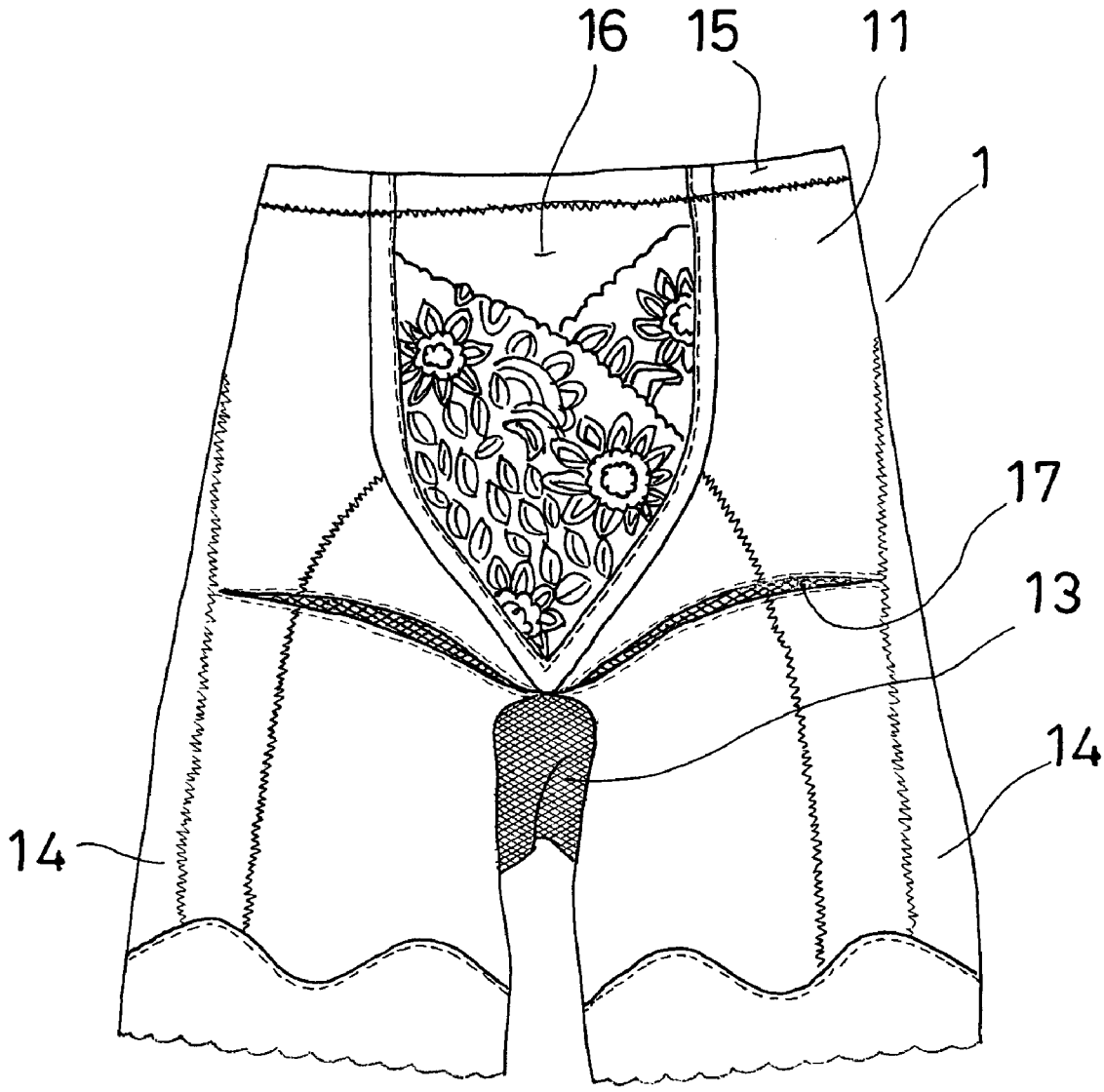
FIG. 2 is a front view of the shaping pant of the present invention.

Referring to FIGS. 1 and 2, a preferred embodiment 1 of a shaping pant of the invention is made of perfectly tailored inner and outer layers of elastic cloth, which are sewn together by means of sewing machines. The shaping pant 1 includes a front 11, a rear 12, and a bottom 13. The bottom 13 is joined to the front 11 and the rear 12 at two lateral edges thereof, and there are tight thigh-tube portions 14 under the bottom 13, which tight thigh-tube portions 14 are used to shape the thighs of a wearer. And, the tight thigh-tube portions 14 have wave-shaped lace bands at lower ends thereof. A tight waist part 15 is joined to upper ends of both the front 11 and the rear 12. A front middle 16 is joined to a middle portion of the front 11, which is used to shape the belly of a wearer. Upper sections of two sides of the front middle 15 are parallel, and a lower portion of the middle front 15 tapers towards a center of the pant 1. Furthermore, elastic parts 17 are joined to lower edges of the front 11 and upper edges of the tight thigh-tube portions 14.

Figure 3:
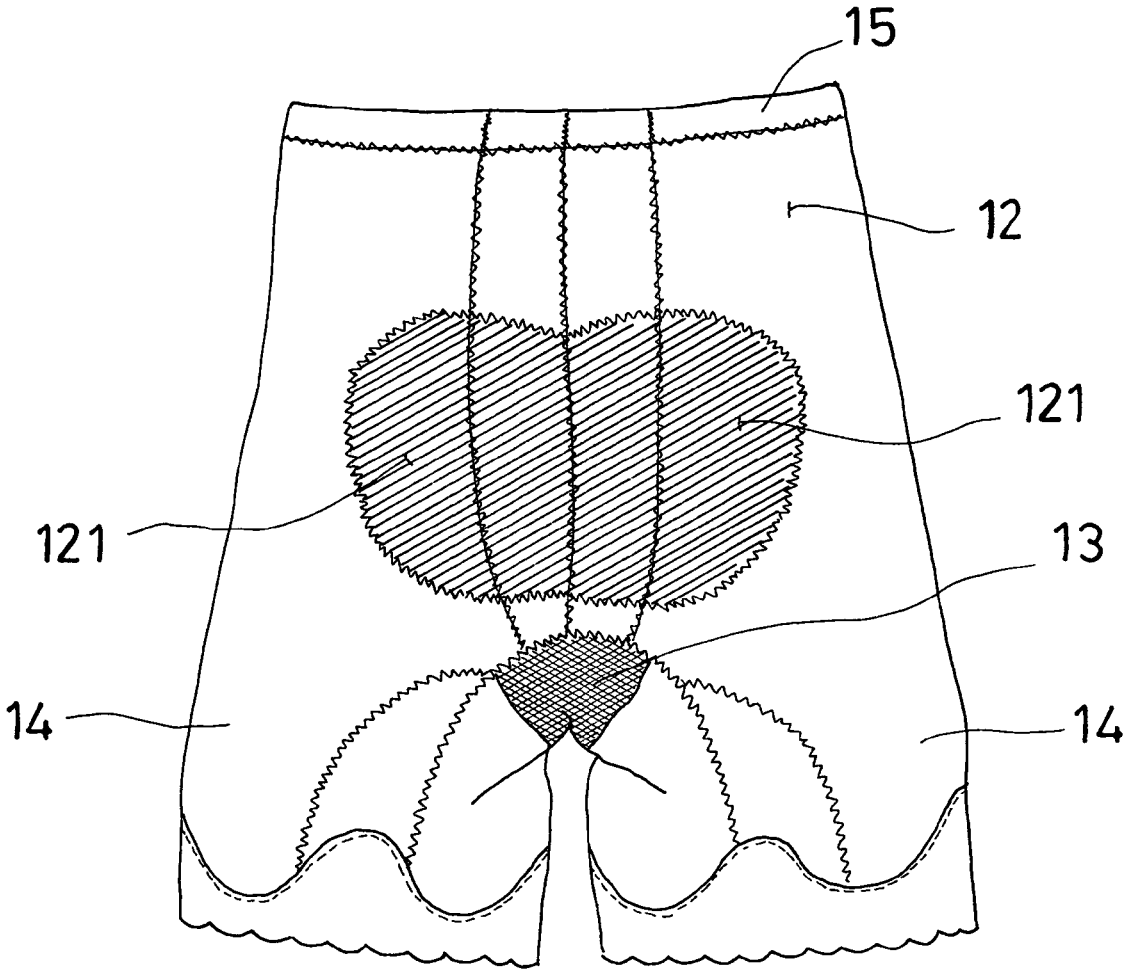
FIG. 3 is a rear view of the shaping pant of the invention.
Figure 4:
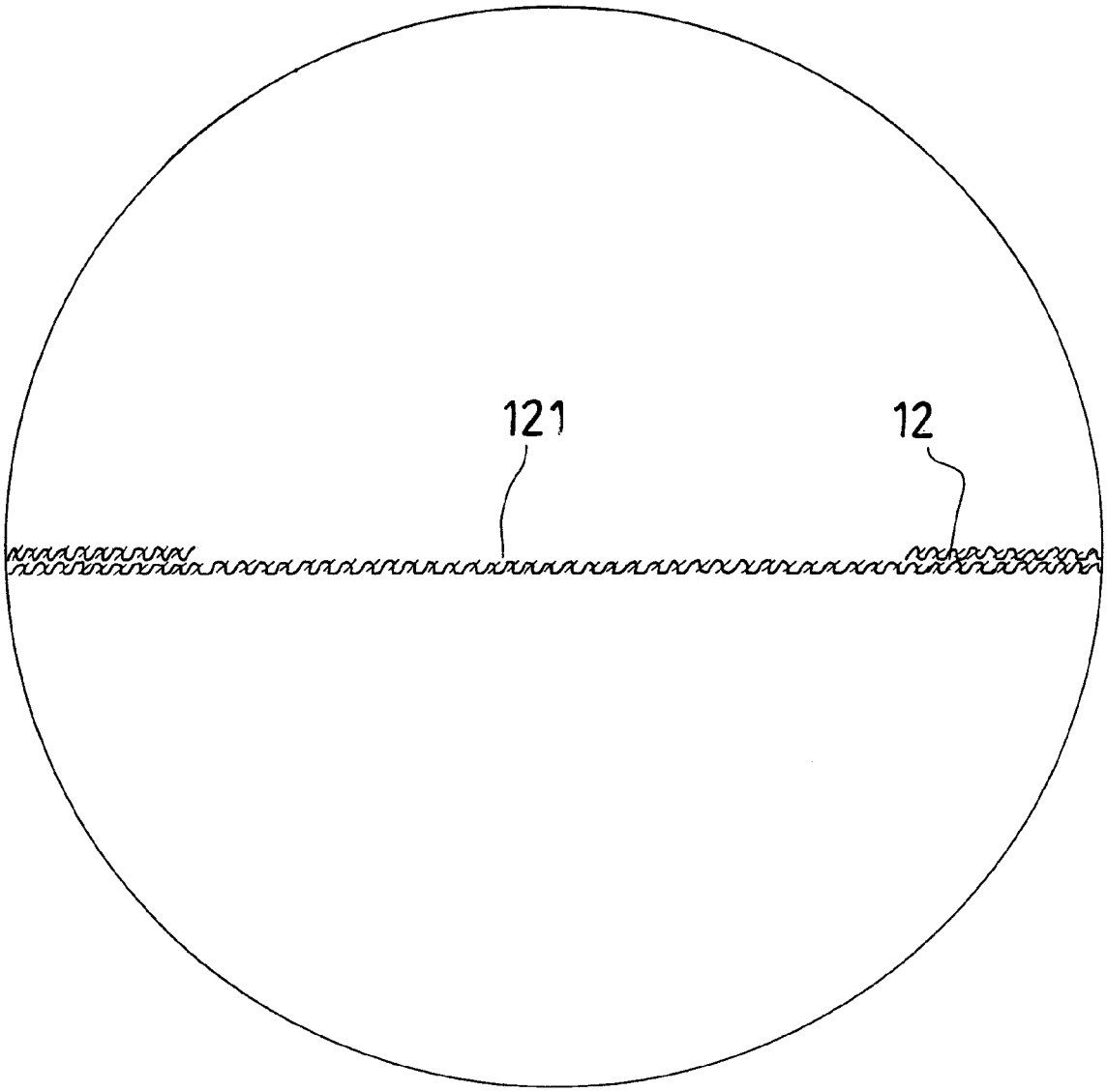
FIG. 4 is a sectional view of the single-layer enhancing portion.

Referring to FIGS. 1 and 3, which are a perspective view and a front view of the shaping pant 1 worn on a lady, the rear 12 has a single-layer gathering portion 121 at a middle thereof as shown in FIG. 4, which is substantially in the shape of a heart, symmetric about a central line of the shaping pant 1 and slightly curving outwards; an outer one of elastic cloth layers of the rear 12 is formed with a hole thereon, and the single-layer gathering portion 121 is an inner one of the elastic cloth layers of the rear 12, and is sewn in position with non-elastic embroidering threads at edges thereof. Therefore, the single-layer gathering portion 121 is more elastic and comfortable, and air can travel through the single-layer gathering portion 121 more easily.

When a lady wears the shaping pant 1, adjacent portions of her buttocks will be on the single-layer gathering portion 121 of the rear 12. Because the single-layer gathering portion 121 is substantially in the shape of a heart, symmetric about a central line of the shaping pant 1 and slightly curving outwards, and sewn in position at edges thereof, superfluous fleshes of the wearer's buttocks near to the tights will be pushed to and gathered at the single-layer gathering portion 121, and butt-lifting effect of the shaping pant 1 will increase. Consequently, the wearer's butt will be lifted and beautifully shaped, looking rounder.

Those portions of each of the inner and the outer elastic cloth layers of the front 11 and the rear 12 that will be over the underbelly, vertebra, and front sides of the tights of a wearer can be a piece of elastic mesh cloth with negative ions. And, the bottom 13 can be a piece of nanometer light catalyst cloth or a piece of elastic mesh cloth with negative ions. The outer elastic cloth layer of each of the tight thigh tube portions 14 is a piece of elastic mesh cloth with negative ions. The lateral portions of the inner elastic cloth layers of the tight thigh tube portions 14, which will be over the inner and the outer sides of the tights of a wearer, are made in such a way that they can absorb moisture and allow perspiration to flow out. Consequently, the shaping pant 1 will be more comfortable to wear.

From the above description, it can be easily seen that the shaping pant of the present invention has the following advantages: the single-layer gathering portion is relatively elastic and comfortable, and air can travel through the single-layer enhancing portion easily; superfluous fleshes of the wearer's buttocks near to the tights will be pushed to and gathered at the single-layer gathering portion, and butt-lifting effect of the shaping pant will increase. Consequently, the wearer's butt will be lifted and beautifully shaped, looking rounder.

What is claimed is:

1. An improvement on a shaping pant for shaping a users buttocks comprising:

the shaping pant being made of tailored inner and outer layers of an elastic cloth, which is sewn together by means of sewing machines;

the shaping pant including:

a front;

a bottom;

a rear; the rear having a single-layer gathering portion at a middle of the shaping pant thereof, which is substantially in the shape of a heart, curving outwardly transversely and being symmetric about a central line of the shaping pant; the single-layer gathering portion being sewn in position around edges of the shaping pant thereof, the single-layer gathering portion being transversely stitched around the outer peripheries of the buttocks to permit the excessive fat from both sides of the outer peripheries of the buttocks to be lifted, gripped, and consolidated according to the contour of the outer periphery of the buttocks.

2. The shaping pant as claimed in claim 1, wherein an outer one of elastic cloth layers of the rear is formed with a hole thereon, and the single-layer gathering portion is an inner one of the elastic cloth layers of the rear.

3. The shaping pant as claimed in claim 1, wherein the single-layer gathering portion of the rear is sewn in position with non-elastic embroidering threads at edges thereof.

4. The shaping pant as claimed in claim 1, wherein each of the inner and outer elastic cloth layers of the front is a piece of elastic mesh cloth.

5. The shaping pant as claimed in claim 1, wherein the bottom is joined to the front and the rear at two lateral edges thereof, and there are tight thigh-tube portions under the bottom, which are used to shape a wearer's thighs.

6. The shaping pant as claimed in claim 1, wherein a tight waist part is joined to upper ends of both the front and the rear.

7. The shaping pant as claimed in claim 1, wherein a front middle is joined to a middle portion of the front for shaping a wearer's belly.

* * * * *